US006435281B1

(12) United States Patent
Baugh

(10) Patent No.: US 6,435,281 B1
(45) Date of Patent: Aug. 20, 2002

(54) INVISIBLE LINER

(76) Inventor: Benton F. Baugh, 14626 Oak Bend, Houston, TX (US) 77079-6441

( * ) Notice: Subject to any disclaimer, the term of this patent is extended or adjusted under 35 U.S.C. 154(b) by 49 days.

(21) Appl. No.: 09/668,583

(22) Filed: Sep. 25, 2000

(51) Int. Cl.[7] ..... E21B 17/00; E21B 17/14; E21B 19/22

(52) U.S. Cl. ..... 166/382; 166/207; 166/208; 166/242.2; 166/242.8

(58) Field of Search ..... 166/77.1, 77.2, 166/207, 208, 242.2, 242.8, 277, 285, 382; 405/154

(56) References Cited

U.S. PATENT DOCUMENTS 3,104,703 A * 9/1963 Rike et al. ..... 166/207
3,354,955 A * 11/1967 Berry ..... 166/207
3,746,092 A * 7/1973 Land ..... 166/207
4,673,035 A * 6/1987 Gipson ..... 166/77.2
4,715,443 A * 12/1987 Gidley ..... 166/55.1
5,337,823 A * 8/1994 Nobileau ..... 166/277
5,794,702 A * 8/1998 Nobileau ..... 166/380
5,833,001 A * 11/1998 Song et al. ..... 166/287
6,112,818 A * 9/2000 Campbell ..... 166/207 X
6,253,850 B1 * 7/2001 Nazzai et al. ..... 166/277

OTHER PUBLICATIONS

"Reeled Expandable Casing Creates Single Diameter Well", Offshore Magazine, p. 32, May 1997.*
"Cold–forged Connector Ties Back Well Risers in Congo Field", Oil & Gas Journal, p. 90, May 5, 1997.*
"Use of Bi–Center PDC Bit Reduces Drilling Cost", reprinted from Oil & Gas Journal, Nov. 13, 1995.*

* cited by examiner

*Primary Examiner*—George Suchfield

(57) ABSTRACT

An impervious metallic liner for the isolation of the well bore from the formations of an oil or gas well below a casing string; the liner being flattened to run through the casing string, but is inflated to occupy the space directly below the casing string rather than occupying the conventional area radially inward from the position occupied by the casing string.

18 Claims, 4 Drawing Sheets

INVISIBLE LINER

BACKGROUND OF THE INVENTION

The field of this invention of that of liner hangers for the isolation of the well bore of oil and gas wells from the earth formations through which the oil or gas well is being drilled.

As different producing, water, and other formations through which the drilled well will pass must be isolated from each other, a casing string must be cemented in place to isolate each zone. An oil or gas well is typically drilled by first deciding the minimum bore of the production string of casing, or the last pipe to be cemented in place and will be continuous from the surface all the way down to the oil or gas producing formations. This production string of casing must be large enough to allow the production tubing landed inside it to flow enough oil or gas to make the well economic.

Each casing set point requires that an additional concentric casing string be set. A typical set of casing strings in a subsea environment from the inside out would be 7" 9.625" 11.750", 13.375", and 16" set within an 18.750" bore blowout preventer stack, and 20 and 30" casing strings set before the 18.750" bore blowout preventer stack is installed. Each casing string occupies a certain amount of radial space, requiring that the next string of pipe be progressively smaller. That program provides a maximum of 5 casing set points with blowout preventer protection during drilling.

Typically, a casing string, i.e. 11.75" outer diameter, is installed in a drill well bore suspended from the surface to a depth such as 10,000 feet deep. After cementing the 11.750" casing in place, a hole is drilled with a bit through the 11.750" casing, i.e. 10.50" diameter hole to 12,000 feet deep. Into this hole a 9.625" outside diameter casing can be landed and cemented in place. If the 9.625" casing string is suspended from the surface and is therefore 12,000 feet long, it is called a casing string. If, however, the 9.625" casing is only 2000' long and is suspended by a hanger from the lower end of the 11.750" casing string, it is called a liner. The use of a liner can save substantially on the cost of casing and cement, e.g. 10,000 feet of casing not purchased. The well program would be followed with a 7.000" casing string continuous from the surface to the bottom of the well as the production casing string.

The 9.625" liner in the example above would have saved the operator the 10,000 feet of pipe not purchased, with the cost of a conventional liner hanger being generally offset by the cost of the surface casing hanger. The liner still "costs" the drilling company the "radial space", forcing the next string to be progressively larger.

In this conventional scenario, if an unexpected pressured formation is encountered and requires that an extra casing string is set, it would probably be 5.500" in size. With the 5.500" size, the tubing string landed inside would be reduced from 3" to 2", substantially restricting the flow of production from the well. Flow from wells is especially important offshore where the high cost of drilling and producing wells demands a high flow rate to be economic. Cases have been seen of abandonment of wells when an extra pressurized reservoir zone was encountered and the driller realized that his final well bore size would be too small to be economic.

SUMMARY OF THE INVENTION

The object of this invention is to provide a liner which does not occupy "radial space" in the well bore and therefore does force each previously set casing hanger to be a step larger in diameter.

A second object of the present invention is to provide the capability of installing multiple liners in a drilling program to compensate for unforeseen well control situations.

A third object of the present invention is to provide a liner that can be rolled up for compact storage and shipment.

Another object of the present invention is to provide a liner assembly that is compact enough to be airlifted out to an offshore drilling vessel.

Another object of the present invention is to provide an expandable liner which is metallic in construction and impervious to fluid flow.

DESCRIPTION OF THE PREFERRED EMBODIMENT

Figure 1:
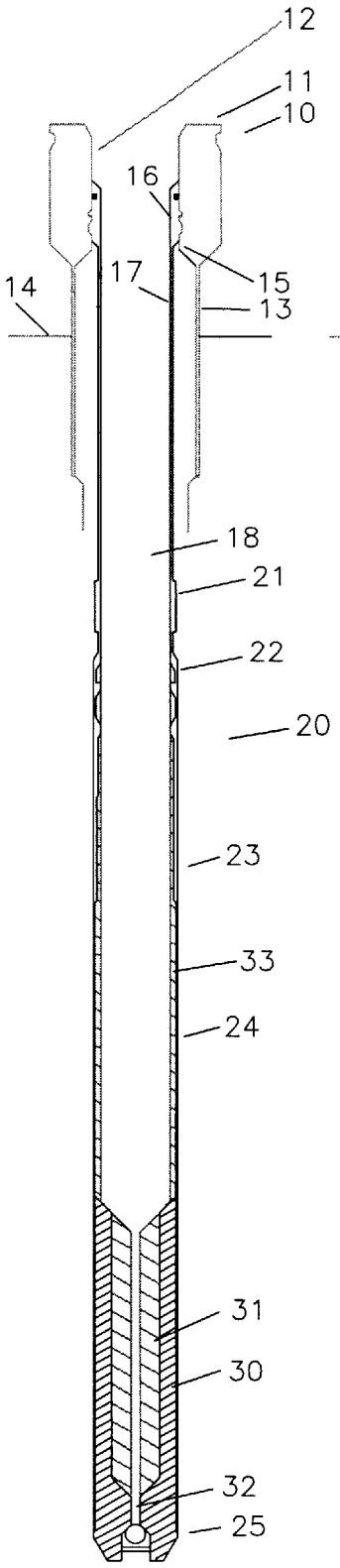
FIG. 1 is a section through the oil or gas well as would remain after the previous casing string has been set and landed in place.

Referring now to FIG. 1, an oil or gas well 10 is shown with a subsea housing 11 at the top with a 13.625" nominal housing bore 12 at the top. The subsea housing 11 is supported on a surface casing string 13 which penetrates the seafloor 14. Within the housing bore 12 and on shoulder 15 a casing hanger 16 is landed. Casing string 17 having a well bore 18 extends down into the well and terminates in a casing shoe 20.

Casing shoe 20 attached to casing string 17 by casing coupling 21 and has a landing profile 22 near its upper end. Below the landing profile is a support profile 23, and enlarged pipe section 24, and a float shoe portion 25. Immediately above the float shoe portion is a standard cement annular portion 30 with a pilot bore 31 and a through bore 32. In the bore of the landing profile 22, the enlarged pipe section 23, and the pilot bore 31, a low strength material 33 is cast in place which will be usefully removed as seen further in this description.

Figure 2:
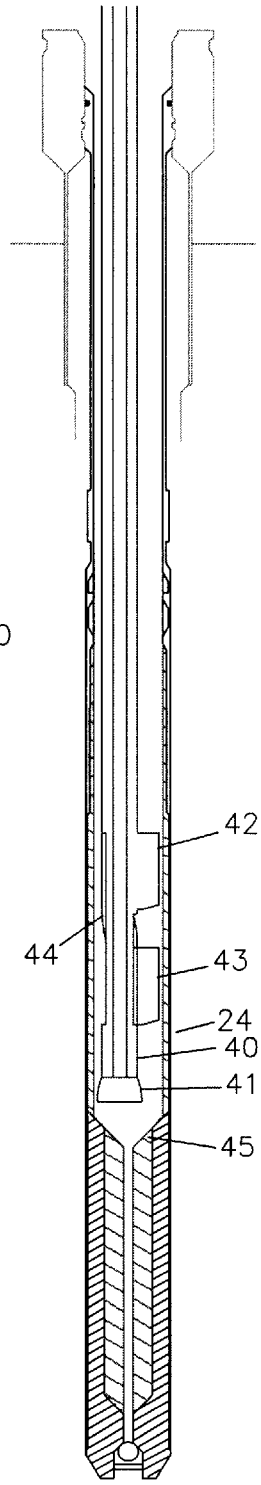
FIG. 2 is a section through the oil or gas well showing the bi-center bit approaching the specialized shoe.

Referring now to FIG. 2, a bi-center bit 40 is run into the enlarged pipe section. The bi-center bit includes a pilot bit portion 41, a fixed hole opener section 42, and a rotatable hole opener section 43 mounted on a spiral 44. Conventionally, a special trip with a collapsible hole opener is required because a bi-center bit cannot be started within the casing due to the potential of damage to the bit. In this invention, the pilot bit is automatically centralized within the pilot bit preparation 45 to allow it to be concentric within the well prior to the beginning of rotation. The combination of this centralization and the enlarged pipe section allow for the immediate rotation of the bi-center bit without the need for a conventional hole opener run.

Figure 3:
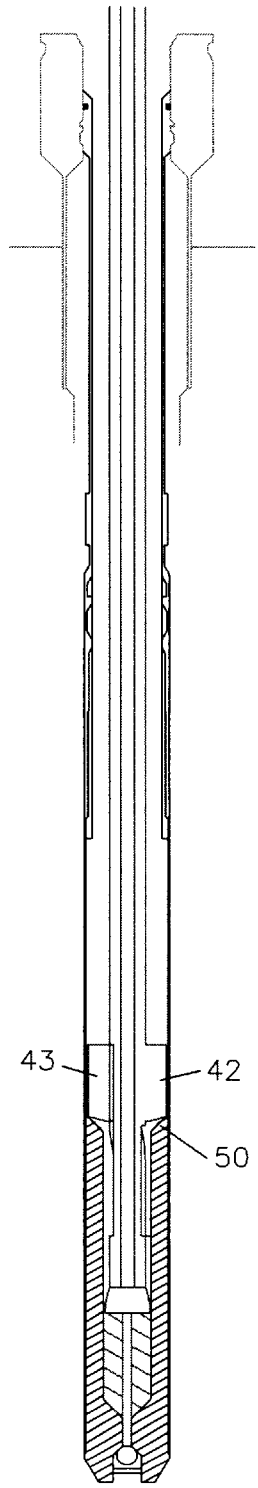
FIG. 3 is a section through the oil or gas well showing the bi-center bit centralized and drilling within the pilot section of the existing float shoe.

Referring now to FIG. 3, the pilot bit 41 is now drilling out the low strength material 33 as the rotatable hole opener section 43 contacts the top 50 of the standard cement annular portion 30 and remains vertically stationary as it rotates until the fixed hole opener section 42 catches up with it and they begin to drill the cement section together. At that time the pilot bit, rotatable hole opener section, and fixed hole opener section work together to drill out the cement shoe and continue to drill the oil or gas well deeper.

Figure 4A:
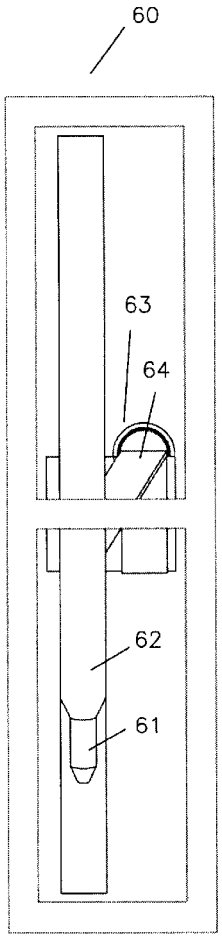
FIG. 4A is a front view of the reeled liner as it would be shipped to the well site.
Figure 4B:
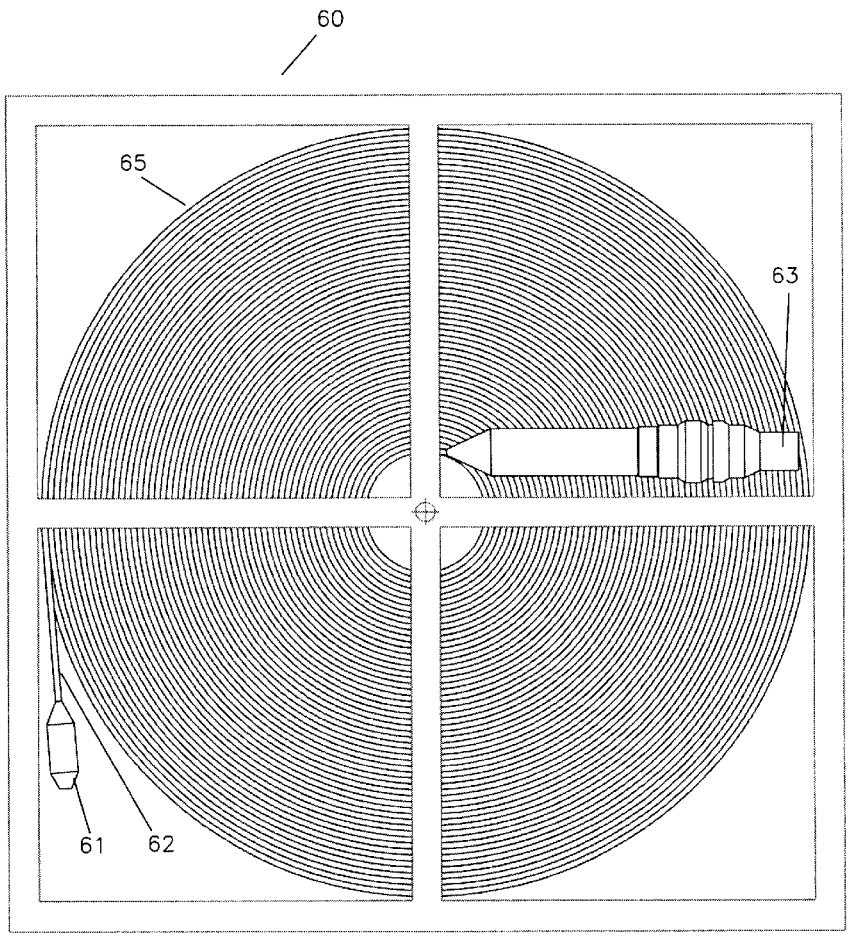
FIG. 4B is a side view of the reeled liner illustrating the position of the float shoe and support means.

Referring now to FIG. 4, the liner of this invention is delivered to the well site on a reel 60 with a float shoe 61 near its outer end 62 and a support section 63 near its inner end 64. The liner 65 is folded and flattened and rolled up on the reel for ease of transportation and storage. Either an 11.750"×0.250 wall×1000 ft. or a 9.625"×0.156 wall×2000 ft. liner can be airlifted for offshore service at about 30,000 lbs. The package size would be approximately 12 ft.×12 ft.×2.5 ft.

Figure 5:
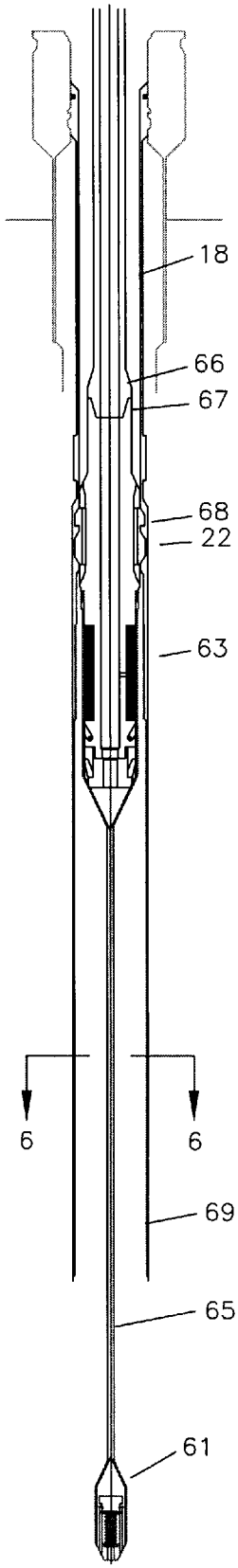
FIG. 5 is a section showing that the liner is inserted into the well, but has not been inflated.

Referring now to FIG. 5, the liner is unreeled into the well bore 18 until drill string threaded connection 66 is attached to the upper thread 67 of the support section 63. The lowering continues until expandable landing ring 68 engages landing profile 22 to position the support section 63. The main portion of the liner 65 is in a flattened state suspended in the drilled well bore 69.

Figure 6:
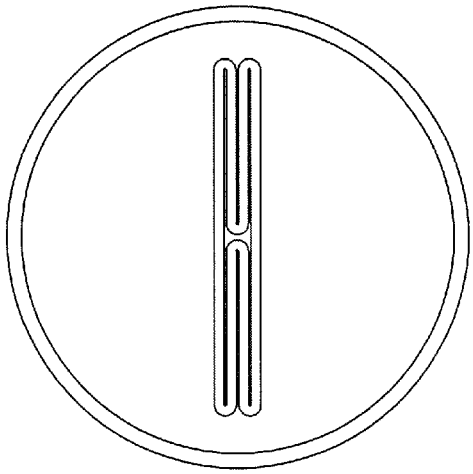
FIG. 6 is a section of the flattened liner as seen in FIG. 5 showing it relative size to the casing string through which it passed.

Referring now to FIG. 6, the section through the well bore 69 and liner 65 shows that the liner has multiple folds to make it both flat and able to be rolled on a reel, and also of a smaller dimension that the hole through which it must pass. The liner is preferably of a size such that the circumference of the inner diameter when expanded to a circular shape is slightly larger than the inner diameter of the casing string through which it passed. In this style, it is effectively invisible with respect to view from the top of the well.

Figure 7:
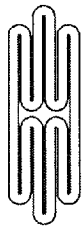
FIG. 7 is a section through a liner which has been flattened to a different pattern.

Referring now to FIG. 7, an alternate folding style is illustrated which yields a smaller package for entering into the well bore but somewhat more complex to fold and will tend to make a larger diameter reel for transportation.

Figure 8:
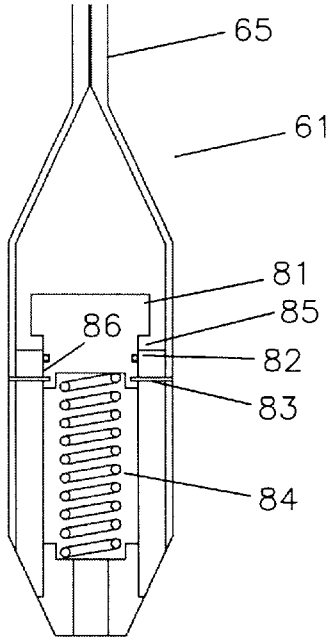
FIG. 8 is a section through the float shoe showing the means to allow for holding pressure on the first pressure cycle and then not holding pressure on subsequent pressure cycles.

Referring now to FIG. 8, a float shoe 61 depends from the lower end of the liner 65, having a plug 81 with a seal 82. Shear pins 83 hold the plug 81 in an initial position against the spring 84. The first time the liner 65 is pressurized for inflation, the shear pins 83 shear and allow the plug 81 to move down against shoulder 85. After the inflation pressure is released, the spring 84 will move the plug 81 out of the bore 86 and allow for cement to be circulated through the shoe to cement the liner in place.

Figure 9:
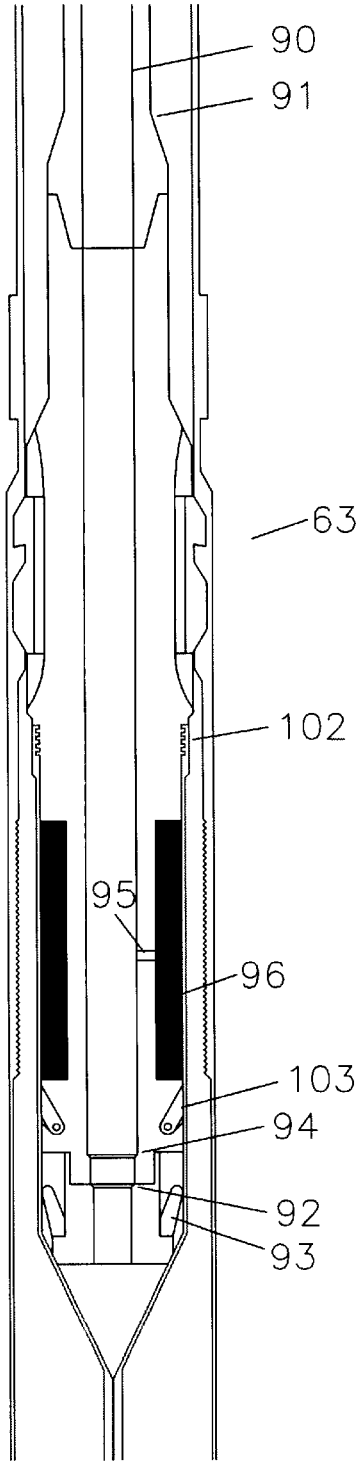
FIG. 9 is a section through the liner support means.

Referring to FIG. 9, the support section 63 is shown in greater detail prior to inflating the liner 65. After the inflation cycle and the opening of the float shoe as described above, a cementing plug (not shown) will be pumped down the bore 90 of the running string 91 until it hits shoulder 92 of cement cup 93 and pumps it to the float shoe 61.

As the cementing plug and cement cup 93 approach the cement shoe, a support shoulder dart (not shown) is placed in the bore 90 of the running string 91 until it lands and stops on shoulder 94. The support shoulder dart seals below the port 95 to allow high pressure from above in the running string to be vented to the inner diameter of the packer 96. The packer expands to expand the upper section 100 of the liner 65 out to engage the profile 101 of the support section 63. The profile 101 is made of a high yield material relative to the strength of the upper section 100 such that when the upper section 101 is expanded and released a compressive load will be retained between the surfaces.

After the upper section 100 is engaged and supported within profile 101, the running string 91 is rotated to the right to unscrew from the connection to the top of the liner at thread 102. Spring loaded milling cutters 103 are automatically deployed and remove any unexpanded section of the liner as the unit moves upward.

Figure 10:
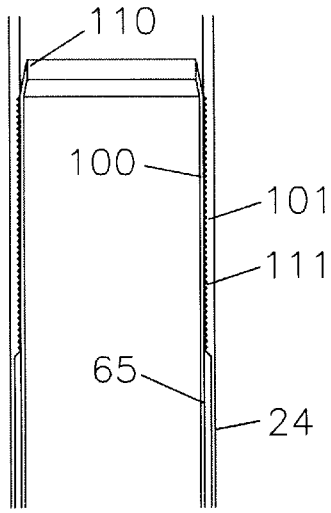
FIG. 10 is a section showing that the liner has been expanded into an enlarged section at the lower end of the casing string.

Referring now to FIG. 10, the upper end 100 of the liner 65 is supported in support profile 101, and the milled end 110 of the upper section is seen remaining. The interface 111 between the liner upper end 100 and the support profile 101 provides for mechanical support of the liner (in addition to the cement) plus a metal to metal seal between the two parts.

Figure 11:
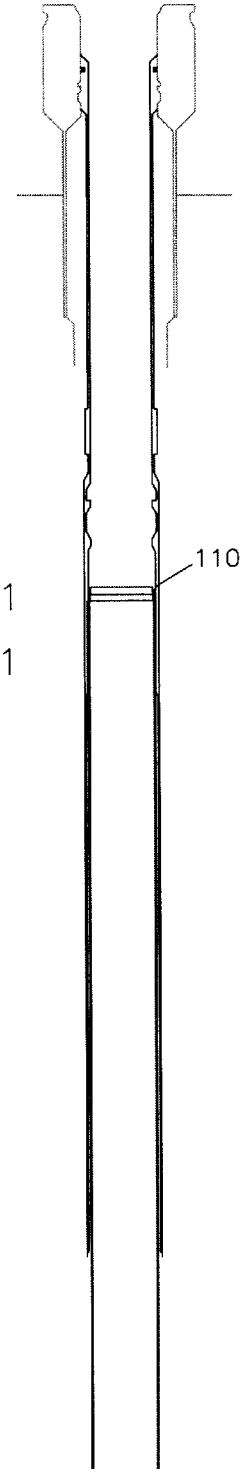
FIG. 11 is a section through the oil or gas well showing the liner as landed, expanded and sealing in the lower end of the casing string.

Referring now to FIG. 11, a completed view of an installed invisible liner is seen after a conventional bit is used to drill out through the float shoe and continued to drill the well deeper.

The foregoing disclosure and description of this invention are illustrative and explanatory thereof, and various changes in the size, shape, and materials as well as the details of the illustrated construction may be made without departing from the spirit of the invention.

I claim:

1. The method of providing well bore protection between the bore of the oil or gas well and the formations outside the well bore by inserting a liner into the bore of a casing string in said oil or gas well to a position extending below the lower end of said casing string wherein the circumference of the outer perimeter of said liner is greater than the circumference of the inner diameter of said casing string, and further comprising the flattening said liner such that the maximum non-axial dimension is less that the inner diameter of said casing string.

2. The method of claim 1, further comprising the rolling said liner on a reel means for transportation to said oil or gas well.

3. The method of claim 2, further comprising the unrolling said liner and lowering said liner into said well bore.

4. The method of claim 3, further comprising the said liner having a float shoe at its lower end which seals against a pressure on a first pressure cycle to inflate said liner and then vents pressure on a subsequent pressure cycle.

5. The method of claim 4, further comprising the said liner having a hanger means near its upper end which can be expanded to engage the lower end of said casing string.

6. The method of providing well bore protection between the bore of the oil or gas well and the formations outside the well bore by inserting a liner into the bore of a casing string in said oil or gas well to a position extending below the lower end of said casing string wherein the circumference of the outer perimeter of said liner is greater than the circumference of the inner diameter of said casing string, and further providing an enlarged internal diameter of the lower portion of said casing string to allow said liner to be engaged with said enlarged internal diameter of said casing string for at least partial support of said liner, and further comprising the flattening said liner such that the maximum non-axial dimension is less that the inner diameter of said casing string.

7. The method of claim 6, further comprising the rolling said liner on a reel means for transportation to said oil or gas well and the unrolling said liner and lowering said liner into said well bore.

8. The method of claim 6, further comprising the said liner having a hanger near its upper end which can be expanded to engage said enlarged internal diameter of said casing string.

9. The method of providing well bore protection between the bore of the oil or gas well and the formations outside the well bore by inserting a liner into the bore of a casing string in said oil or gas well to a position extending below the lower end of said casing string wherein the circumference of the outer perimeter of said liner is greater than the circumference of the inner diameter of said casing string, comprising flattening said liner such that the maximum non-axial dimension is less that the inner diameter of said casing string, rolling said liner on a reel means for transportation to said oil or gas well, unrolling said liner and lowering said liner into said well bore, said liner having a float shoe at its lower end which seals against a pressure on a first pressure cycle to inflate said liner and then vents pressure on a subsequent pressure cycle, and expanding hanger means on said liner to engage the lower end of said casing string.

10. The method of claim 9, wherein said liner is flattened such that the maximum non-axial dimension is less that the inner diameter of said casing string by pushing in two opposing sides and then flattening said liner.

11. The method of claim 9, wherein said venting of said pressure occurs by the first pressure loading on a piston means and shearing a shear pin.

12. The method of claim 9, wherein said expanding hanger means comprises expanding a liner portion, expanding a tool comprising a resilient packer element for accepting pressure to expand said expanding liner portion, and cutting away such portion of said expandable liner portion which is not expanded to a diameter larger than the internal diameter of said casing string.

13. The method of claim 9 wherein said hanger means comprises an expandable portion which is of a mechanical yield strength and the lower end of said casing string includes a hanger portion which is larger than the internal diameter of said casing string and is of a higher mechanical yield strength than said expandable portion, expanding said expandable portion until radially loaded and yielded out to contact said hanger portion, continuing to expand said hanger means such that said hanger portion is stressed to a stress higher than the mechanical yield strength of said expandable portion, releasing said radial loading such that a mechanical loading will remain between said expandable portion and said hanger portion .

14. The method of claim 13, wherein said remaining loading will provide a supporting force for said liner.

15. The method of claim 13, wherein said remaining loading will provide a sealing between said expandable portion and said hanger portion.

16. The method of claim 9 wherein said liner sealingly engages the lower end of said casing string.

17. The method of claim 9 wherein said lower end of said casing string comprises an expanded portion for accepting the support means of said liner.

18. The method of claim 9, wherein said liner is metallic and impervious.

* * * * *